US007775897B2

(12) United States Patent
Jones

(10) Patent No.: US 7,775,897 B2
(45) Date of Patent: Aug. 17, 2010

(54) MECHANICAL SEMI-AUTOMATIC TEE-UP DEVICE AND METHOD

(76) Inventor: Donald R Jones, 5533 Diamond Mill Rd., Brookville, OH (US) 45309

( * ) Notice: Subject to any disclaimer, the term of this patent is extended or adjusted under 35 U.S.C. 154(b) by 1503 days.

(21) Appl. No.: 10/715,056

(22) Filed: Nov. 17, 2003

(65) Prior Publication Data

US 2004/0127302 A1 Jul. 1, 2004

Related U.S. Application Data

(60) Provisional application No. 60/435,450, filed on Dec. 20, 2002.

(51) Int. Cl.
*A63B 57/00* (2006.01)
*A63B 69/36* (2006.01)

(52) U.S. Cl. ..... 473/133; 473/132; 473/134; 473/135; 473/136; 473/137; 473/279; 473/386

(58) Field of Classification Search ..... 473/131–137, 473/150, 278–279, 386–388, 392, 405
See application file for complete search history.

(56) References Cited

U.S. PATENT DOCUMENTS 3,693,979 A * 9/1972 Koett ..... 473/279
3,966,213 A 6/1976 Bradley
4,017,087 A 4/1977 Bruno
4,077,659 A 3/1978 Sievers
4,141,558 A * 2/1979 Hoffman ..... 473/132
4,177,996 A 12/1979 Chang
4,181,309 A * 1/1980 Atkinson et al. ..... 473/136
4,198,054 A * 4/1980 Stone ..... 473/134
4,265,453 A 5/1981 Loof
4,319,753 A 3/1982 Mann
4,331,332 A * 5/1982 Hughes ..... 473/279
4,346,896 A * 8/1982 Russell et al. ..... 473/279
4,355,811 A * 10/1982 Williams, Sr. ..... 473/136
4,360,199 A 11/1982 Jackson
4,589,661 A 5/1986 Attig
4,741,537 A 5/1988 Adam
4,779,796 A * 10/1988 Lai ..... 473/279

(Continued)

FOREIGN PATENT DOCUMENTS

WO WO 03004110 A1 * 1/2003

OTHER PUBLICATIONS

Automated Tee-Up Systems, Golf Range Magazine, Jan./Feb. 2003, pp. 24-28, 30, & 32.

(Continued)

*Primary Examiner*—Scott Jones
*Assistant Examiner*—Milap Shah
(74) *Attorney, Agent, or Firm*—Dane C Butzer

(57) ABSTRACT

An automatic tee-up device including a golf ball reservoir, a platform with a groove for a golf ball to travel from the reservoir to a tee, and a ball ejector disposed to eject golf balls one at a time from the reservoir onto the groove. The tee is movable from below a level of the golf ball in the groove to above the level of the golf ball in the groove. After the golf ball is ejected by the ejector, the golf ball travels on the groove to the tee and is raised by the tee into a position suitable for striking with a golf club.

16 Claims, 4 Drawing Sheets

U.S. PATENT DOCUMENTS

| | | | | | |
|---|---|---|---|---|---|
| 4,815,744 | A | | 3/1989 | Diamandis | |
| 4,832,345 | A | | 5/1989 | Monasco | |
| 4,875,685 | A | * | 10/1989 | Ballinger et al. | 473/262 |
| 4,886,276 | A | | 12/1989 | Digangi | |
| 4,949,961 | A | | 8/1990 | Milano | |
| 4,951,947 | A | | 8/1990 | Kopfle | |
| 4,969,646 | A | | 11/1990 | Tobias | |
| 4,995,614 | A | | 2/1991 | Tange | |
| 5,016,886 | A | | 5/1991 | Gould | |
| 5,022,657 | A | | 6/1991 | Bussiere | |
| 5,080,357 | A | | 1/1992 | Wolf | |
| 5,171,010 | A | | 12/1992 | Lanoue | |
| 5,259,622 | A | * | 11/1993 | Irving | 473/132 |
| 5,282,628 | A | * | 2/1994 | Komori et al. | 473/136 |
| 5,326,107 | A | | 7/1994 | Park | |
| 5,346,222 | A | * | 9/1994 | Luther, Sr. | 473/137 |
| 5,351,964 | A | | 10/1994 | Kruger | |
| 5,390,931 | A | | 2/1995 | Chiasson | |
| 5,415,409 | A | | 5/1995 | Hellmann | |
| 5,464,223 | A | | 11/1995 | Dermott | |
| 5,494,279 | A | | 2/1996 | Ahner | |
| 5,499,813 | A | | 3/1996 | Black | |
| 5,529,307 | A | * | 6/1996 | Chang | 473/136 |
| 5,549,299 | A | * | 8/1996 | Brown | 473/133 |
| 5,599,237 | A | | 2/1997 | Fetterman | |
| 5,624,325 | A | | 4/1997 | Smith | |
| 5,645,491 | A | | 7/1997 | Brown | |
| 5,647,805 | A | | 7/1997 | Tarbox | |
| 5,667,222 | A | | 9/1997 | Bunyi | |
| 5,672,121 | A | | 9/1997 | Miller | |
| 5,728,012 | A | | 3/1998 | Boelling | |
| 5,759,117 | A | | 6/1998 | Erickson | |
| 5,772,533 | A | | 6/1998 | Dahlmann | |
| 5,913,737 | A | | 6/1999 | Park | |
| 5,971,862 | A | * | 10/1999 | Yates | 473/137 |
| 6,024,654 | A | | 2/2000 | Chun | |
| 6,053,821 | A | | 4/2000 | Palmer | |
| 6,056,651 | A | | 5/2000 | Malinoff | |
| 6,062,989 | A | | 5/2000 | Wagner | |
| 6,106,405 | A | * | 8/2000 | Fox | 473/137 |
| 6,120,383 | A | | 9/2000 | Brown | |
| 6,139,441 | A | | 10/2000 | Fairchild | |
| D434,460 | S | | 11/2000 | Carter | |
| 6,159,108 | A | | 12/2000 | de la Pena | |
| 6,165,082 | A | | 12/2000 | Cox | |
| 6,203,452 | B1 | | 3/2001 | Kelman | |
| 6,273,833 | B1 | | 8/2001 | Murphy | |
| 6,315,676 | B1 | | 11/2001 | Sandlin | |
| 6,328,659 | B1 | | 12/2001 | Peterson | |
| 6,338,685 | B1 | | 1/2002 | Posluszny | |
| 6,348,008 | B1 | | 2/2002 | Bertoniere, Jr. | |
| 6,419,589 | B1 | | 7/2002 | Carter | |
| 6,450,895 | B1 | | 9/2002 | Galluzzo | |
| 6,461,254 | B1 | | 10/2002 | Ballett | |
| 6,997,816 | B2 | * | 2/2006 | Gager | 473/137 |
| 7,166,034 | B2 | * | 1/2007 | Hines et al. | 473/137 |
| 2003/0004004 | A1 | * | 1/2003 | Adolf | 473/137 |
| 2003/0162598 | A1 | * | 8/2003 | Eckardt, Jr. et al. | 473/135 |
| 2005/0020370 | A1 | * | 1/2005 | Howe et al. | 473/135 |

OTHER PUBLICATIONS

"Orlando Launch of Pareto's Revolutionary New Auto-Tee Up System," Pareto Golf Inc., Charlotte, NC (from a tradeshow in early 2004).

CD-ROM with promotional video for Pareto's "New Auto-Tee Up System" (from a tradeshow in early 2004).

* cited by examiner

MECHANICAL SEMI-AUTOMATIC TEE-UP DEVICE AND METHOD

CROSS REFERENCE TO RELATED PROVISIONAL APPLICATION

This application claims priority from and hereby incorporates by reference U.S. Provisional Application No. 60/435,450, filed Dec. 20, 2002, in the name of the inventor Donald R. Jones.

BACKGROUND OF THE INVENTION

1. Field of the Invention

This invention relates to an automatic tee-up device and method for use by golfers.

2. Description of the Related Art

Golf is enjoyed by people of all different ages and physical abilities. As with all sports, golf improves with practice. One form of practice is to hit a large number of balls from a relatively fixed tee, for example at a driving range.

Unfortunately, many golfers find the driving range experience to be less than satisfactory. The process of bending over repeatedly to place golf balls on a tee can be tiresome, and for older or disabled golfers, even painful.

Automatic tee-up devices are known in the art. However, these devices tend to be complicated pieces of machinery that use various springs, pistons, motors and electrical control devices in their operation. As a result, they tend to be expensive and to require significant technical maintenance. Automatic tee-up devices of this type are therefore fairly rare. They are primarily restricted to high-end driving ranges and wealthy individuals who can afford the expense and maintenance required to keep them running.

Some simpler mechanical automatic tee-up devices do exist. However, these devices tend to attempt to balance a ball on a fixed tee. If the device is not lined up exactly with the tee, the ball tends to fall off the tee.

Furthermore, many of the known automatic tee-up devices use pipes or tubes to store and/or to transport golf balls. Unfortunately, golf balls can get jammed in these pipes or tubes, especially if the pipes or tubes become fouled with dirt or otherwise obstructed by foreign objects.

SUMMARY OF THE INVENTION

In view of the foregoing, a need exists for a simple robust automatic tee-up device that does not require extensive technical maintenance. Such a device would find wider acceptance and usage by driving ranges. Furthermore, a need exists for such a device that can be easily moved, set-up, used, and stored, thereby facilitating residential use.

The invention addresses these needs with an automatic tee-up device including a golf ball reservoir, a platform with a groove for a golf ball to travel from the reservoir to a tee, and a ball ejector disposed to eject golf balls one at a time from the reservoir onto the groove. The tee is movable from below a level of the golf ball in the groove to above the level of the golf ball in the groove. After the golf ball is ejected by the ejector, the golf ball travels on the groove to the tee and is raised by the tee into a position suitable for striking with a golf club.

In a preferred embodiment, the platform includes a mat that has the groove, and the mat with the groove is removable from the rest of the platform. Preferably, the platform includes at least one other mat positioned where a golfer stands on the platform.

Also in the preferred embodiment, the ball ejector and the tee are actuated by a lever that projects from the platform. The lever can be disposed to be actuated by a head of the golf club moved in a horizontal arc. Preferably, the lever is connected to a ramp and the tee is connected to a tapered block that rests on the ramp such that movement of the ramp causes the tee to raise or to lower. The tee preferably can be removable so as to facilitate replacement.

In order to help a golfer to practice swings with golf balls teed at different heights, different positions of the lever can correspond to different tee heights. The preferred embodiment of the platform includes a scale adjacent the lever corresponding to the tee heights.

The preferred embodiment also preferably includes leveler feet on which the platform rests. The leveler feet permit the platform to be leveled.

One embodiment of the automatic tee-up device is particularly suited for residential use. The residential model preferably includes at least one hinge by which the platform can be folded up. In this model, the groove is in a removable mat on the platform, the platform includes at least two mats positioned where a golfer stands on the platform, and a seam between the two mats aligns with the hinge. This arrangement facilitates folding up of the device into a more compact form. The device can also include wheels disposed for moving the automatic tee-up device when the platform is folded up.

Commercial (e.g., driving range) models of the automatic tee-up device can include some or all of the features of the residential model.

The invention also encompasses methods of using, storing, and maintaining the various embodiments of the automatic tee-up device.

This brief summary has been provided so that the nature of the invention may be understood quickly. A more complete understanding of the invention may be obtained by reference to the following description of the preferred embodiments thereof in connection with the attached drawings.

DESCRIPTION OF THE PREFERRED EMBODIMENT

Preferred Embodiments

Figure 1:
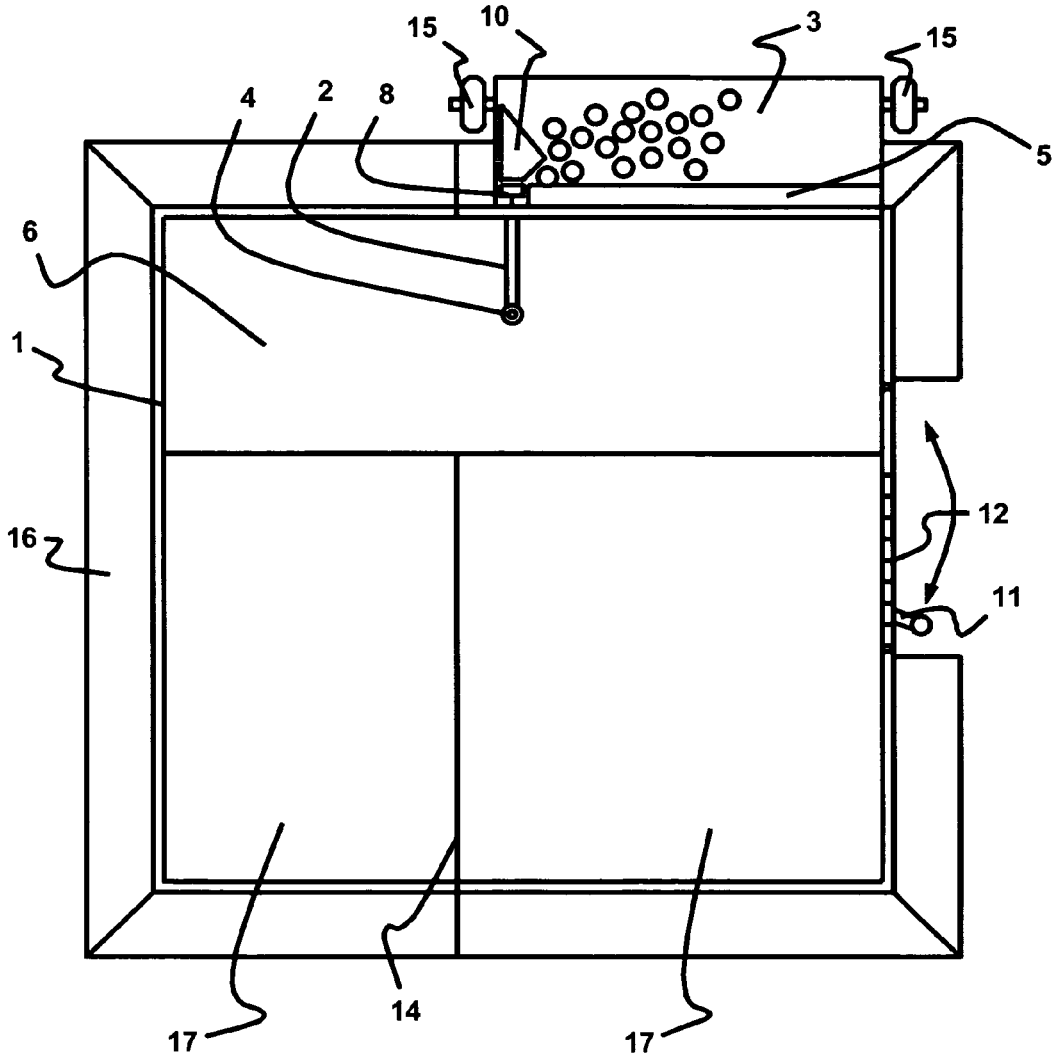
FIG. 1 shows a top view of an automatic tee-up device according to one embodiment of the invention.

FIG. 1 shows a top view of an automatic tee-up device according to one embodiment of the invention.

Briefly, one embodiment of the invention is an automatic tee-up device including a golf ball reservoir, a platform with a groove for a golf ball to travel from the reservoir to a tee, and a ball ejector disposed to eject golf balls one at a time from the reservoir onto the groove. The tee is movable from below a level of the golf ball in the groove to above the level of the golf ball in the groove. After the golf ball is ejected by the ejector, the golf ball travels on the groove to the tee and is raised by the tee into a position suitable for striking with a golf club.

In more detail, the device in FIG. 1 includes platform 1 with groove 2 for golf balls to travel from golf ball reservoir 3 to tee 4. The tee preferably is a rubber tee, although other types of tees can be used.

Edge 5 of reservoir 3 preferable is curved, for example in a concave shape, so as to permit a golfer to pull golf balls from reservoir 3 directly onto the surface of the device using a golf club. This permits the golfer to circumvent use of the tee-up mechanism if so desired, for example to practice fairway or chip shots.

In the embodiment shown in FIG. 1, platform 1 includes mat 6 that has groove 2. Matt 6 also includes a hole for passage of tee 4 up through the matt. Preferably, mat 6 is easily removable to facilitate replacement when the mat wears out. In one embodiment, mat 6 simply sets on top of the front part of the platform. A more permanently affixed mat can be used without departing from the invention.

The device in FIG. 1 also includes ejector 8 disposed to eject golf balls one at a time from reservoir 3, which has been loaded with golf balls, onto groove 2. An ejected ball travels down groove 2 to tee 4. The tee is movable from below a level of the golf ball in groove 2 to above the level of the golf ball in groove 2. A golf ball that has traveled down groove 2 to tee 4 is raised by tee 4 into a position suitable for striking with a golf club.

Ball ejector 8 preferably operates in conjunction with agitating block 10 so as to eject the golf balls one at a time. Ball ejector 8 and agitating block 10 are actuated by lever 11. The lever preferably is disposed to be actuated by a head of a golf club moved in a horizontal arc, for example as shown by the double-headed curved arrow in FIG. 1. The end of the lever is preferably made of or affixed to some material or object that tends to minimize damage to a head of a club used to manipulate the lever. In one embodiment, this material is a golf ball mounted on the end of the lever. Other materials and objects can be used.

Moving lever 11 from the position shown in FIG. 1 to the other end of the arrow causes tee 4 to lower and a golf ball to be loaded onto ball ejector 8. Reservoir 3 preferably is slanted toward ejector 8 to facilitate loading of the golf ball. Then, movement of lever 11 back toward the position shown in FIG. 1 causes the ball to be ejected onto groove 2. The ball follows grove 2 until it is positioned over tee 4. Continuation of the movement of the lever to the position shown in FIG. 1 causes the top of the tee to rise from below a level of the golf ball in the groove to above the level of the golf ball in the groove, thereby raising the golf ball to a suitable position for striking with a golf club.

The interoperation of ball ejector 8, agitating block 10, and lever 11 is explained in more detail below with reference to FIGS. 4 and 5.

In the preferred embodiment, different positions of lever 11 correspond to different tee heights. The device in FIG. 1 includes scale 12 adjacent lever 11 that relates different lever positions to different heights of tee 4. This feature permits a golfer to practice different types of shots. Other embodiments of the invention can have limited tee heights and may not have a corresponding scale.

In operation, a golfer steps onto the automatic tee-up device over edge 16 of platform 1. The edge preferably is tapered to facilitate a smooth transition onto the platform. The tapered edge also facilitates movement of a handicapped person, for example in a wheelchair, onto the device.

The golfer actuates lever 11 to cause a golf ball to be loaded onto ball ejector 8 and then ejected from reservoir 3 onto groove 2, which guides the golf ball to tee 4. Once the ball is at tee 4, the golfer continues to actuate lever 11 to cause tee 4 to raise the golf ball to a desired height. The golfer then strikes the ball. The process of loading, ejecting, raising, and striking golf balls can be repeated without the golfer having to bend over to tee up golf balls. Of course, the golfer can bend over or otherwise move about if so desired.

The embodiment of the automatic tee-up device shown in FIG. 1 is intended to be used as a residential model. This embodiment can be used in any other setting as well.

In order to facilitate residential use, the device in FIG. 1 is designed to be folded up and rolled away for easy storage. Thus, the device includes hinge 14 and wheels 15. The device also includes mats 17 where a golfer's feet tend to be positioned. Mats 17 are arranged so that a seam between the mats lines up with the hinge. These mats can be more permanently attached or more securely fastened than mat 6 because they tend to wear much more slowly. Alternatively, these mats also can be easily removable.

Mat 6 preferably is removed before folding up the automatic tee-up device in FIG. 1. Alternatively, this mat can also be divided into two mats with a seam at the hinge. However, the seam can be caught be a swung club, so use of a single mat 6 at the front of the device is preferred.

After mat 6 is removed and the device is folded at hinge 14, the device can be rolled away on wheels 15. Thus, storage of the automatic tee-up device is relatively easy.

The residential model of the automatic tee-up device according to the invention also preferably includes a cover plate or screen (not shown) on the bottom of platform 1. The cover plate or screen protects the moving parts in the device from interference from materials and protrusions upon which the device is set, for example grass and the like.

Figure 2:
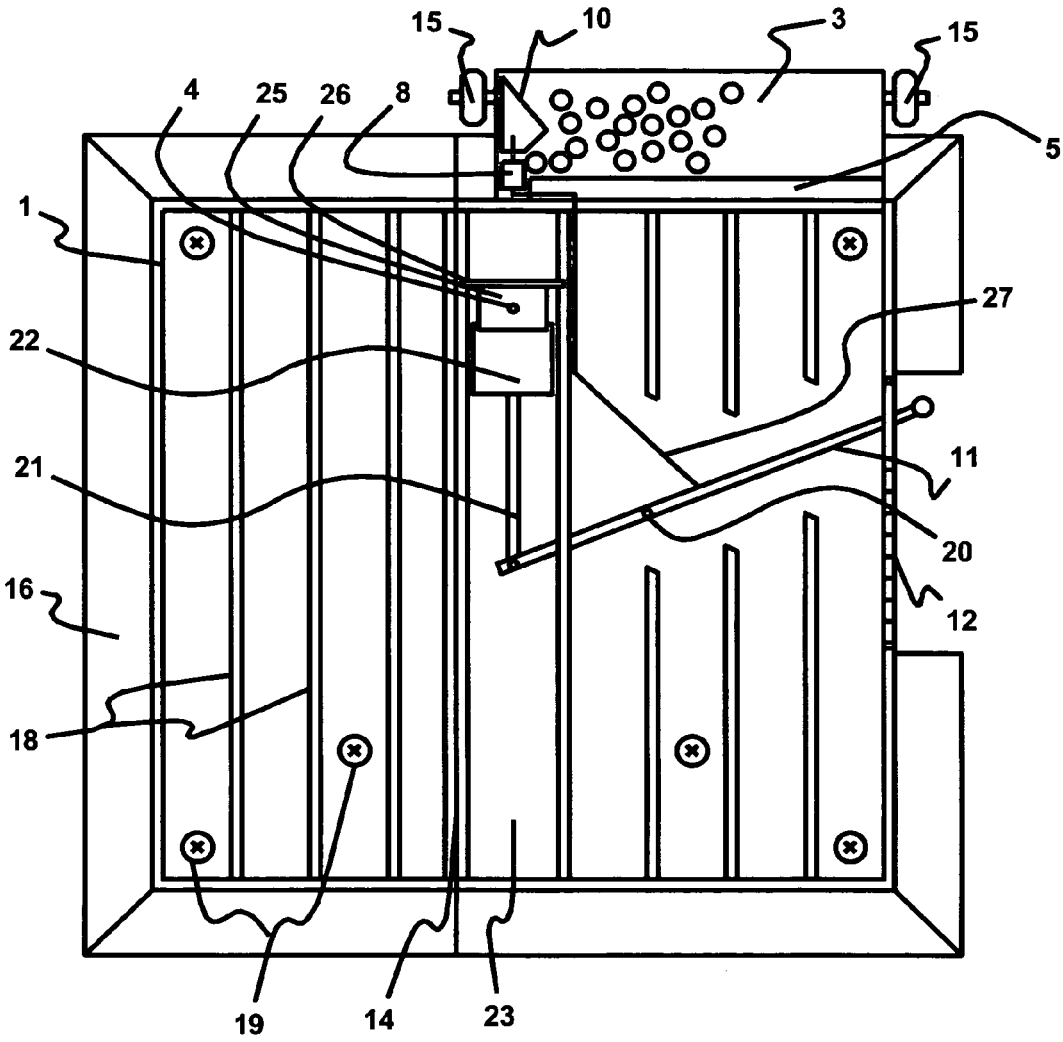
FIG. 2 shows a cut-away top view of the automatic tee-up device shown in FIG. 1.
Figure 3:
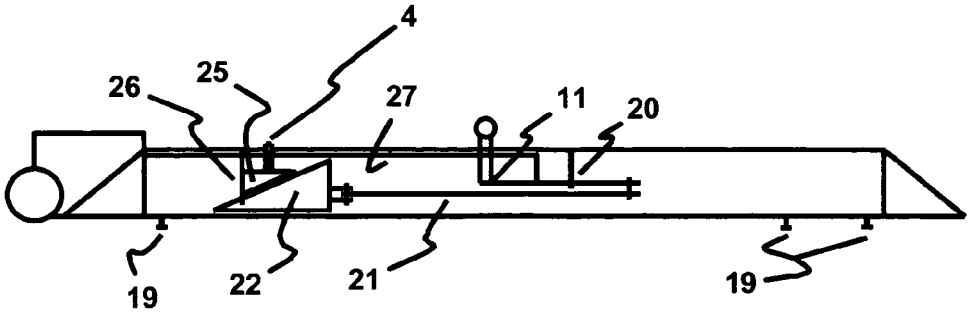
FIG. 3 shows a cut-away side view of the automatic tee-up device shown in FIG. 1.

FIGS. 2 and 3 show additional details of the structure of the embodiment shown in FIG. 1. FIG. 2 is a cut-away top view with the mats and any cover plate or panel (not shown) removed, and FIG. 3 is a cut-away side view showing the lever mechanism in the main body of the platform.

FIG. 2 shows reinforcing cross braces 18. These braces help the automatic tee-up device withstand the weight of a golfer. Different bracing arrangements and other designs, for example a solid cover piece, can be used without departing from the invention.

As shown in FIGS. 2 and 3, leveler feet 19 are provided for leveling the automatic tee-up device. Different leveling arrangements also can be used. The leveler feet can be omitted. However, in some embodiments, leveler feet 19 are particularly useful, for example in embodiments intended for use at driving ranges, which tend to have very uneven surfaces where golfers stand.

FIGS. 2 and 3 also show more details of the operation of ball ejector 8, agitating block 10, lever 11, and tee 4 in the embodiment shown in FIG. 1. The invention is not limited to the particular arrangement and operation depicted in these Figures.

In FIGS. 2 and 3, lever 11 pivots on fixed pivot point 20, for example a vertical fixed rod. Lever 11 is connected to push rod 21, which in turn is connected to ramp 22 in raceway 23. Thus, as lever 11 is moved forward and backward, ramp 22 moves backward and forward in raceway 23.

Tapered block 25 sits on ramp 22. The tapered block includes tee 4 or a retainer for tee 4. In a preferred embodiment, the retainer is horseshoe shaped, facilitating removal and replacement of tees.

The tapered block also includes a piece that fits into key 26 in the walls of raceway 23. Thus, as ramp 22 moves back and forth in raceway 23, tapered block 25 is constrained by key 26 to move down and up, thereby moving tee 4 down and up.

Lever 11 is also connected to rod 27. In the embodiment shown in FIG. 2, rod 27 is connected across pivot point 20 from push rod 21. As a result, rod 27 and push rod 21 move in opposite directions when lever 11 is moved.

Rod 27 is in turn is connected to a mechanism for ejecting golf balls one at a time. In FIG. 2, this mechanism includes ball ejector 8 and agitating block 10. The mechanism is not shown in FIG. 3, but is shown in more detail in FIGS. 4 and 5.

The agitating block preferably also serves to agitate golf balls in reservoir 3. While the invention can be implemented with without the agitating block, golf balls in those embodiments can tend to jam up in the reservoir.

Figure 4:
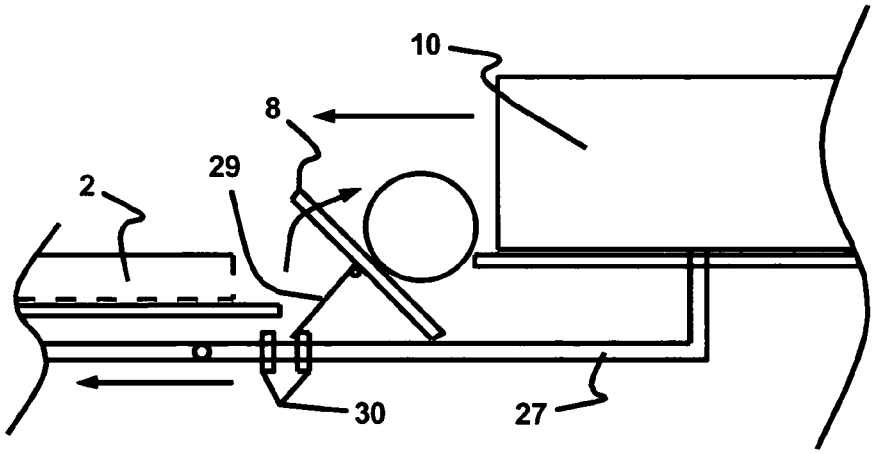
FIGS. 4 and 5 show operation of a ball ejector and agitating block used by an automatic tee-up device according to one embodiment of the invention.
Figure 5:
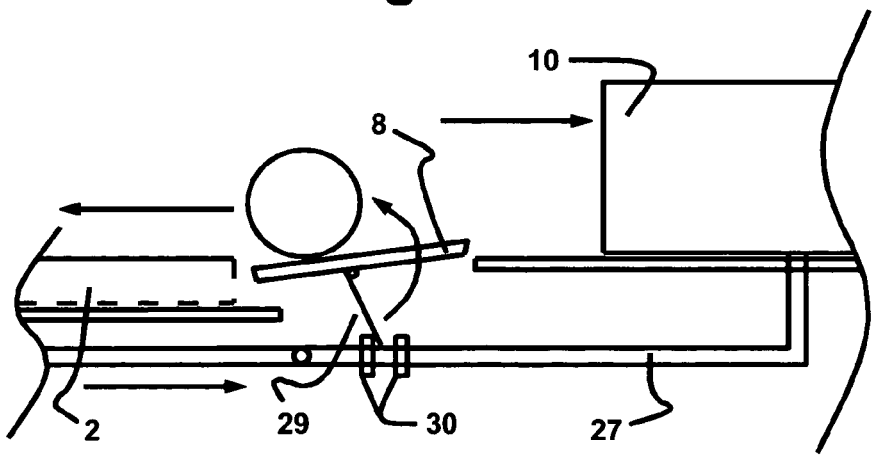

FIGS. 4 and 5 show operation of a ball ejector and agitating block used by an automatic tee-up device according to one embodiment of the invention.

In FIG. 4, rod 27 has been pulled from right to left by lever 11. Rod 27 is connected to agitating block 10, which also have been moved from right to left. This action has pushed a golf ball onto ball ejector 8 and preferably has also agitated golf balls in reservoir 3.

Ball ejector 8 in FIG. 4 has been rotated clockwise by rod 27 so as to hold the ball pushed by agitating block 8. In FIGS. 4 and 5, rod 27 rotates ball ejector 8 via extension 29 sandwiched between protrusions (e.g., nuts or lugs) 30 fastened to rod 27. Other arrangements for rotating the ball ejector can be used.

In FIG. 5, rod 27 has been pushed from left to right by lever 11, moving block 10 to the right. This movement creates an opening for another ball to be loaded onto ball ejector 8 and also preferably again agitates golf balls in reservoir 3. Furthermore, ball ejector 8 has been rotated counterclockwise by rod 27, thereby ejecting the ball onto groove 2.

Applicant has found the foregoing ball ejection apparatus to be simple, effective, and durable. The apparatus also is extremely easy to maintain. Of course, as mentioned before, the invention is not limited to this particular arrangement.

Figure 6:
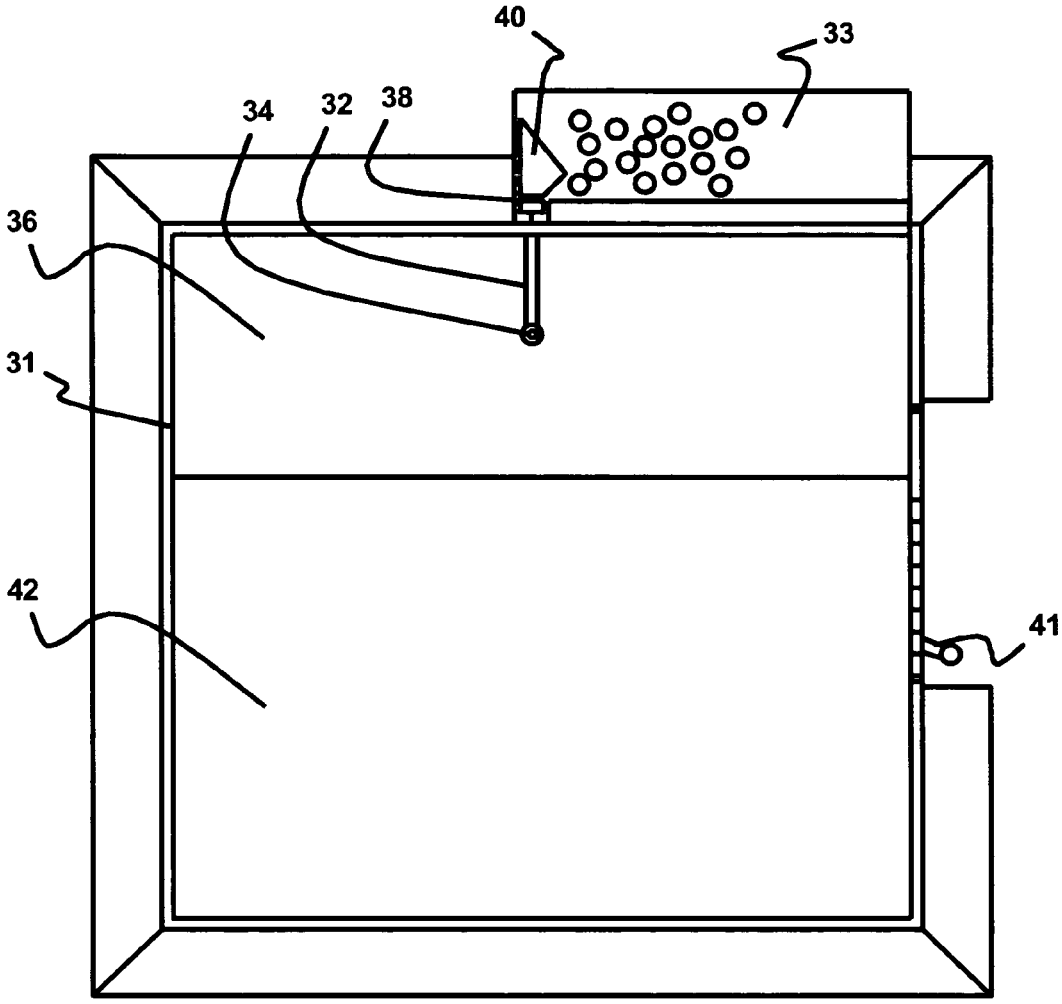
FIG. 6 shows a top view of a different embodiment of an automatic tee-up device according to the invention.

FIG. 6 shows a top view of a different embodiment of an automatic tee-up device according to the invention. This embodiment is intended to be used as a commercial model, for example at driving ranges. While the embodiment shown in FIG. 1 could also be used in this setting, the embodiment in FIG. 6 might server better as a commercial model. The embodiment in FIG. 6 is not limited to commercial use and can be used in any other setting as well, including residential use.

In more detail, the device in FIG. 6 includes platform 31 with groove 32 for golf balls to travel from golf ball reservoir 33 to tee 34. The tee preferably is a rubber tee, although other types of tees can be used.

In this embodiment, platform 31 includes mat 36 that has groove 32. Matt 36 also includes a hole for passage of tee 34 up through the matt. Preferably, mat 36 is easily removable to facilitate replacement when the mat wears out. A more permanently affixed mat can be used without departing from the invention.

The device in FIG. 6 also includes ejector 38 disposed to eject golf balls one at a time from reservoir 33, which has been loaded with golf balls, onto groove 32. An ejected ball travels down groove 32 to tee 34. The tee is movable from below a level of the golf ball in groove 32 to above the level of the golf ball in groove 32. A golf ball that has traveled down groove 32 to tee 34 is raised by tee 34 into a position suitable for striking with a golf club.

Ball ejector 38 preferably operates in conjunction with agitating block 40 so as to eject the golf balls one at a time. Ball ejector 38 and agitating block 40 are actuated by lever 41 substantially as discussed above with respect to the residential model.

As with the residential model, lever 41 preferably is disposed to be actuated by a head of a golf club moved in a horizontal arc. The end of the lever is preferably made of or affixed to some material or object that tends to minimize damage to a head of a club used to manipulate the lever. In one embodiment, this material is a golf ball mounted on the end of the lever. Other materials and objects can be used.

Because the embodiment shown in FIG. 6 is a commercial model, the embodiment is much more likely to be placed in a single position and then remain there for an extended period of time. Accordingly, the embodiment shown in FIG. 6 does not include wheels or hinges for storage. Furthermore, without hinges, a single mat 42 can be used in place of the two mats 17 in the embodiment shown in FIG. 1.

Alternatively, all of the features from the embodiment shown in FIG. 1 can be added to and used with the embodiment shown in FIG. 6, and vice versa.

Left-Handed Version

The embodiment depicted in the figures is arranged for a right-handed golfer. The invention also encompasses a mirror-image version of the device that could be more easily operated by a left-handed golfer.

Materials

Any of various suitably strong materials can be used to construct the automatic tee-up device according to the invention. These materials include, but are not limited to, wood, steel or other metals, plastic, foam, rubber, carpet, and the like. Any other suitably strong and durable materials can be used. Possible considerations when choosing materials include cost and durability. For example, a residential model could use fewer materials to reduce cost, while a commercial model could use more durable and weather-resistant materials as well as additional bracing and the like to increase durability.

Alternative Embodiments

The invention is in no way limited to the specifics of any particular preferred embodiment disclosed herein. Many variations are possible which remain within the content, scope and spirit of the invention, and these variations would become clear to those skilled in the art after perusal of this application.

What is claimed is:

1. An automatic tee-up device, comprising:

a golf ball reservoir;

a platform with a groove for a golf ball to travel from the reservoir to a tee, with the tee movable from below a level of the golf ball in the groove to above the level of the golf ball in the groove;

a ball ejector disposed to eject golf balls one at a time from the reservoir onto the groove; and a lever that projects from the platform and that actuates the ball ejector and the tee;

wherein after the golf ball is ejected by the ejector, the golf ball travels on the groove to the tee and is raised by the tee into a position suitable for striking with a golf club;

wherein the ball ejector and the tee are actuated by moving an end of the lever in a horizontal arc; and wherein the lever is disposed to be actuated by a head of the golf club.

2. An automatic tee-up device as in claim 1, wherein the platform includes a mat that has the groove.

3. An automatic tee-up device as in claim 2, wherein the mat with the groove is removable from the rest of the platform.

4. An automatic tee-up device as in claim 2, wherein the platform includes at least one other mat positioned where a golfer stands on the platform.

5. An automatic tee-up device as in claim 1, wherein the ball ejector operates in conjunction with an agitating block within the golf ball reservoir so as to eject the golf balls one at a time and so as to agitate golf balls in the reservoir.

6. An automatic tee-up device as in claim 1, wherein the lever is connected to a ramp and the tee is connected to a tapered block that rests on the ramp such that movement of the ramp causes the tee to raise or to lower.

7. An automatic tee-up device as in claim 6, wherein the tee is removable so as to facilitate replacement of the tee.

8. An automatic tee-up device as in claim 1, wherein different positions of the lever correspond to different tee heights, and wherein the platform further includes a scale adjacent the lever corresponding to the tee heights.

9. An automatic tee-up device as in claim 1, further comprising one or more leveler feet on which the platform rests, the leveler feet permitting the platform to be leveled.

10. An automatic tee-up device as in claim 1, wherein the platform further includes at least one hinge by which the platform can be folded up.

11. An automatic tee-up device as in claim 10, wherein the groove is in a removable mat on the platform;

wherein the platform includes at least two mats positioned where a golfer stands on the platform; and wherein a seam between the two mats aligns with the hinge.

12. An automatic tee-up device as in claim 10, wherein further including at least two wheels disposed for moving the automatic tee-up device when the platform is folded up.

13. A method of using an automatic tee-up device, comprising the steps of:

actuating a lever to cause a ball ejector to eject golf balls one at a time from a golf ball reservoir onto a platform with a groove for a golf ball to travel from the reservoir to a tee; and actuating the lever to cause the tee to raise the golf ball, with the tee movable from below a level of the golf ball in the groove to above the level of the golf ball in the groove;

wherein after the golf ball is ejected by the ejector, the golf ball travels on the groove to the tee and is raised by the tee into a position suitable for striking with a golf club; and wherein an end of the lever is actuated by being moved in a horizontal arc and is disposed to be actuated by a head of the golf club.

14. A method as in claim 13, wherein the ball ejector operates in conjunction with an agitating block within the golf ball reservoir so as to eject the golf balls one at a time and so as to agitate golf balls in the reservoir.

15. A method as in claim 13, wherein the lever is connected to a ramp and the tee is connected to a tapered block that rests on the ramp such that movement of the ramp causes the tee to raise or to lower.

16. A method as in claim 13, wherein different positions of the lever correspond to different tee heights, and wherein the platform further includes a scale adjacent the lever corresponding to the tee heights.

* * * * *